United States Patent [19]

Watt et al.

[11] 4,074,503

[45] Feb. 21, 1978

[54] BRICK LAYING DEVICE

[76] Inventors: Robert Duncan Watt; Brian William Gordon Orr, both of 96 Carisbrooke Road, Newport, Isle of Wight, England

[21] Appl. No.: 634,058

[22] Filed: Nov. 21, 1975

[51] Int. Cl.[2] ..... E04D 15/00; E04B 2/00; E04E 11/00

[52] U.S. Cl. ..... 52/749; 52/747; 52/436; 249/83; 249/90

[58] Field of Search ..... 52/749, 745, 747, 436, 52/603; 249/90, 83; 264/261

[56] References Cited

U.S. PATENT DOCUMENTS

| | | | |
|---|---|---|---|
| 820,014 | 5/1906 | Ries | 249/83 |
| 1,444,588 | 2/1923 | Copeland | 249/83 |
| 2,303,062 | 11/1942 | Parkhurst | 249/83 |
| 2,585,283 | 2/1952 | Sommers | 52/749 |
| 2,648,974 | 8/1953 | Sommers | 52/749 |
| 3,030,738 | 4/1962 | Brewer et al. | 52/749 |
| 3,203,070 | 8/1965 | Kolakowski et al. | 249/90 |
| 3,696,576 | 10/1972 | Monteird de Barros | 52/749 |

FOREIGN PATENT DOCUMENTS

| | | | |
|---|---|---|---|
| 1,165,496 | 10/1969 | United Kingdom | 249/83 |

*Primary Examiner*—Price C. Faw, Jr.
*Assistant Examiner*—Robert C. Farber
*Attorney, Agent, or Firm*—William F. Frank

[57] ABSTRACT

A brick laying device comprises a rectangular frame which fits on a course of bricks. The central aperture in the frame defines a trough for a mortar layer to be laid on top of the bricks. At least one longitudinally extending member of the frame has a right angle section, of which one arm extends inwardly over the top of the bricks, and the other extends downwardly on the outside of the bricks to locate the frame on the bricks and to check the linearity of the course.

9 Claims, 4 Drawing Figures

BRICK LAYING DEVICE

This invention relates to a device for use in laying bricks.

Skilled bricklayers are scarce and expensive, and several devices have been proposed to assist the unskilled worker in laying bricks correctly. British patent specification No. 1,165,496 discloses a device for use in laying bricks, which comprises a rectangular frame adapted to be placed on a course of bricks to define a trough of even depth overlying said course wherein a layer of mortar may be laid ready to receive the next brick or bricks to be laid. The rectangular frame of that specification is formed from metal strip, the width of the strip comprising the height dimension of the frame. The frame is located on the course of bricks by lugs fixed to the frame and extending downwards at spaced intervals from the sides of the frame adapted to extend along the course of bricks. This arrangement has the disadvantage that the frame formed from strip material throughout, with the width of the strip forming the height dimension of the frame, provides little rigidity for the frame which in use will have to survive rough treatment. The spaced lugs only locate the frame along the general line of the course of bricks, and the rough treatment to be expected by the frame will probably cause the lugs to become broken off.

It is an object of the invention to provide a device in which one longitudinally extending member has a locating portion extending uniformly along substantially all its length.

Another object of the invention is to provide a device whose frame is rigid in the plane of the top of the course of bricks.

According to the present invention there is provided a device for use in laying bricks, which comprises a rectangular frame adapted to be placed on a course of bricks to define a trough of even depth overlying said course wherein a layer of mortar may be laid ready to receive the next brick or bricks to be laid, the frame having two longitudinally extending members spaced apart and parallel to one another, at least one of the longitudinal members comprising a right angle section, one arm of the section forming a portion adapted to extend outside said course of bricks and the other adapted to extend inwardly over said course of bricks to define one edge of the trough.

Examples of the invention will now be described with reference to the accompanying drawings, in which.

Figure 1:
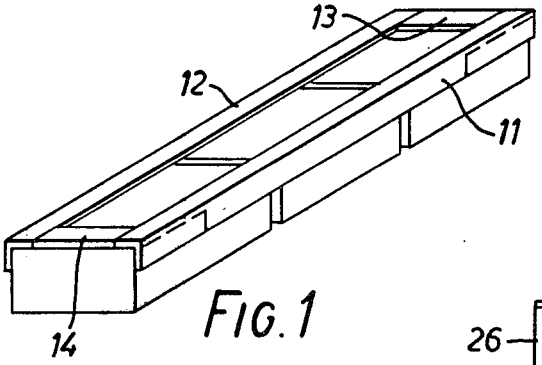
FIG. 1 is a perspective view of a simple rectangular device for use in laying bricks.

The frame illustrated in FIG. 1 comprises a die-cast metal frame having two longitudinally extending right-angled section members 11 and 12, joined at their ends by two strips 13 and 14. FIG. 1 illustrates the frame placed on a course of bricks with the strips 13 and 14 and one arm of each of the members 11 and 12 resting on top of the bricks and defining a trough of even depth overlying the course of bricks. The thickness of the strips and members define the depth of the trough, and this thickness is chosen to suit the required depth of mortar to be applied to the course of bricks. The other arms of the longitudinally extending members 11 and 12 extend closely outside the course of bricks.

In use, the frame is placed on a newly-layed course of bricks and any misalignment of the bricks will immediately become apparent since the downwardly extending portions of the members 11 and 12 will not clear the bricks unless they are correctly aligned. Any misaligned bricks are tapped into place so that the frame can be properly layed with the inwardly extending arms of the members 11 and 12 and the strips 13 and 14 resting on top of the bricks. Mortar is now placed in the trough defined by the frame and smoothed off so that its top surface is level with the top surface of the frame. The frame is then removed and a further course of bricks is layed. The alignment of the further course is similarly adjusted by placing the frame on top. It will be noted that the mortar layed in the trough defined by the frame is recessed along the longitudinal edges of the bricks due to the inward extent of the right-angled sections of the members 11 and 12. The inwards extent of these members is selected to the required recess of the mortar for pointing, and since pointing will probably not be required on the interior side of the wall being built, the rear longitudinal member may comprise a vertical strip alone, with no inwardly directed arm. The frame will be retained in its horizontal position on the course of bricks by the inwardly directed arm of the member 11 and the strips 13 and 14.

The frame has been shown with a longitudinal extent equal to the length of three bricks, but the length of the frame is not critical and does not have to be equal to a multiple of a brick length. The frame should be made of a width appropriate to the bricks being laid, either a single course, or double course, or a cavity wall if the aligning facility of the frame is required. The width of the frame can be made adjustable by any suitable means, such as right and left-threaded screws or interchangeable strips 13 and 14 or by sliding mechanism.

Figure 4:
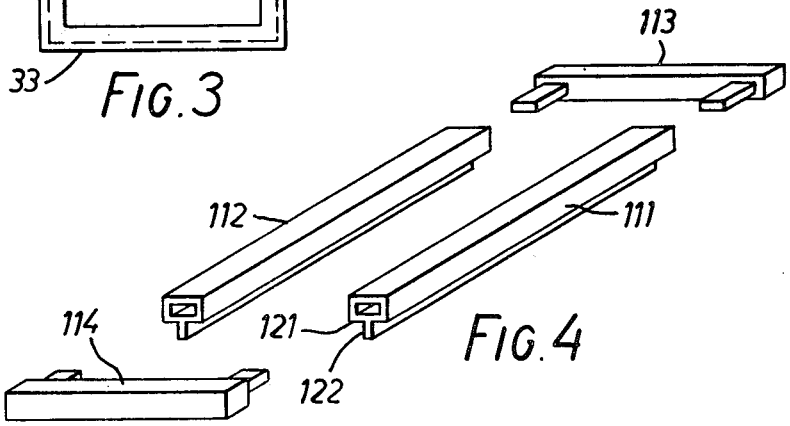
FIG. 4 is an exploded perspective view of another rectangular device for use in laying bricks.

FIG. 4 shows an alternative rectangular frame in which the longitudinal members 111 and 112 are formed by aluminium extrusions having a hollow rectangular section 121 with a fin 122 extending below the centre of the lower edge of the hollow section 121. In FIG. 4, the strips 113 and 114 for joining together the longitudinally extending members 111 and 112 are U-shaped, the arms of the U being adapted to fit in the ends of the hollow section 121 of the longitudinally extending members 111 and 112. The fin 122 of FIG. 4 corresponds to the downwardly extending portion of the members 11 and 12 of FIG. 1, whereas the portion of the lower edge of the rectangular section 121 extending inwards from the fin 122 corresponds to the inwardly extending arms of the members 11 and 12 of FIG. 1. The additional structure of the longitudinally extending members of FIG. 4 provide the bricklaying device with additional strength, but do not themselves serve in aligning the bricks or shuttering the mortar.

Any convenient method of manufacture of the frame can be used, including joining together several metal strips to form the frame, or plastics moulding for example.

Figure 2:
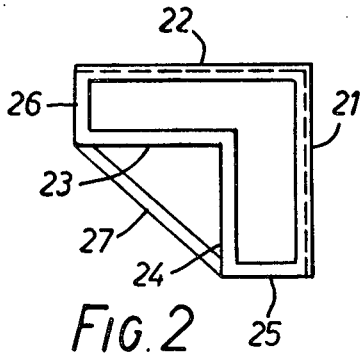
FIG. 2 is a plan of an L-shaped rectangular frame adapted to be placed over a course of bricks at a corner of a building.

FIG. 2 shows a modified frame used at a corner of a building. This frame is L-shaped, with the exterior edges of the arms formed by right-angled sections 21 and 22, the interior edges formed by plain vertical strips 23 and 24, the ends of the arms being formed by cross-strips 25 and 26. The strips 23 and 24 can be replaced by right-angled sections as in FIG. 1, if required. A strengthening member 27 can be added across the inside of the L, if required.

Figure 3:
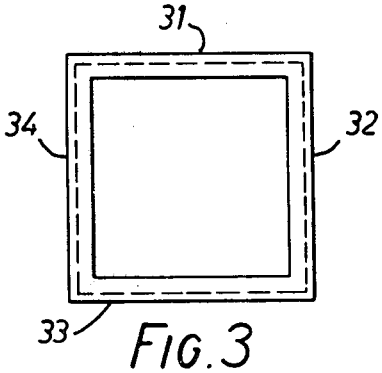
FIG. 3 is a plan of a square frame adapted to be placed over a course of bricks to form a square pillar.

FIG. 3 shows a modified frame for use with a square pillar, the frame including four right-angled section members 31 to 34. Modified devices can be applied to other shapes of walls, including curved or round walls.

The frame of FIG. 1 can be modified by cutting away the downwardly extending arms of the members 11 and 12 at the ends of the frame as shown in dashed lines in FIG. 1 in order to accommodate bricks extending sideways to the main wall, for example at a corner. The downwardly extending arms of the members 11 and 12 still provide the aligning facility at the central part of the frame. This alignment facility is only localised, and it will probably still be necessary to provide a taut string for aligning the whole wall horizontally and vertically.

Slots, grooves or holes or other provisions may be made for the easy attachment of spirit levels to any of the members or strips of the various devices described above in order to ensure that the bricks being laid are not only uniform but also lying in horizontal and vertical planes. A metric measure can be inscribed or otherwise mounted on the frame, for example along the downwardly extending portion of one longitudinally extending member.

What is claimed is:

1. A device for use in laying bricks, which comprises a frame adapted to be placed on a previously laid course of bricks to define a trough of even depth overlying said course wherein a layer of mortar may be laid ready to receive the next brick or bricks to be laid, the frame having two longitudinally extending side members spaced apart and parallel to one another and a pair of parallel spaced apart end members connecting the ends of said side members; at least one of the longitudinal members comprising a horizontally positioned element which rests on the horizontal surface of the said course and a vertically positioned element which rigidly depends from and along the outer edge of said horizontal element and is in contact with the vertical face of said course to insure linear alignment of said course; said horizontal element extending inwardly over said course of bricks to define the whole of one edge of the trough, the inward extension being preselected to provide a required recess for pointing and said horizontal element having a thickness chosen to provide the required depth of mortar to be applied; said spaced end members lying totally above the plane of the underside of said horizontal element when laid over a course of bricks.

2. A device as claimed in claim 1, wherein both longitudinally extending members comprise said horizontally positioned element and said vertically positioned element.

3. A device as claimed in claim 1, wherein said horizontally positioned element comprises a hollow member having at least one vertical surface and at least one horizontal surface and said depending vertical element is integral with said hollow member and spaced from an inner vertical surface of said member a preselected distance to provide said required recess.

4. A device as claimed in claim 3, wherein both said longitudinally extending members comprise said hollow members, and said end members comprise U-shaped end members, the arms of the U-shaped end members being secured inside the ends of the hollow members.

5. A device as claimed in claim 1, wherein the vertical element of the longitudinal member extending outside and along said course of bricks is cut away at its end of a distance equal to the width of one brick.

6. A device as claimed in claim 1 for use with a course of bricks at a corner of a wall comprising two of said at least one side member secured together at right angles to define the outside of said course, two of said other longitudinally extending members spaced apart from and parallel to the respective first-mentioned members, and said end members connecting the respective parallel members at their ends remote from the corner.

7. A device as claimed in claim 6, comprising a strengthening member connected between said connecting means.

8. A device as claimed in claim 1 for use with a course of bricks forming a rectangular pillar, comprising four of said at least one side member secured together to form a rectangle, the said vertical element of each member extending outside and along said course of bricks, and said horizontal element extending inwardly over said course of bricks to define one whole edge of the trough and said required recess.

9. A device as claimed in claim 1, wherein said spaced end members are of adjustable length as required by the width of the course of bricks.

* * * * *